United States Patent [19]

Heilskov

[11] 4,399,891

[45] Aug. 23, 1983

[54] ANCHORING DEVICE FOR FLEXIBLE LADDER

[75] Inventor: Jens A. Heilskov, Madison, Wis.

[73] Assignee: Ray-Jens Corporation, Wilmington, N.C.

[21] Appl. No.: 357,046

[22] Filed: Mar. 11, 1982

[51] Int. Cl.[3] ..... E06C 1/36; E06C 1/397; E06C 1/56

[52] U.S. Cl. ..... 182/150; 182/142; 182/198; 248/317

[58] Field of Search ..... 182/142, 143, 150, 196–198, 182/36, 37, 38; 248/317

[56] References Cited

U.S. PATENT DOCUMENTS

| | | | |
|---|---|---|---|
| 1,101,839 | 6/1914 | Elvestrom | 182/142 |
| 1,421,609 | 7/1922 | Sturm et al. | 182/37 |
| 1,705,958 | 3/1929 | Burrows | 182/37 |
| 2,499,478 | 3/1950 | Feser | 182/38 |
| 3,095,060 | 6/1963 | Reinhardt | 182/142 |
| 3,114,433 | 12/1963 | Downs | 182/142 |
| 3,537,545 | 11/1970 | Willis | 182/142 |
| 3,633,708 | 1/1972 | Heilskov | 182/150 |
| 3,837,429 | 9/1974 | Harris | 182/142 |

*Primary Examiner*—Reinaldo P. Machado
*Attorney, Agent, or Firm*—Wood, Dalton, Phillips, Mason & Rowe

[57] ABSTRACT

An anchoring device for use with a flexible ladder. The ladder is provided with an upper end having connecting elements. The anchoring device is arranged to connect the upper end of the ladder to an upstanding annular access manhole projection, such as provided on a storage spheroid. The anchoring device includes an arcuate caster support having opposite end portions to which are connected the opposite ends of a flexible connector to which the connecting elements of the ladder are movably connected. The caster support is provided with a plurality of casters rotatably mounted to roll about the manhole projection so that the flexible ladder may be hung from the projection for ready adjustability on the spheroid about the vertical axis thereof.

10 Claims, 3 Drawing Figures

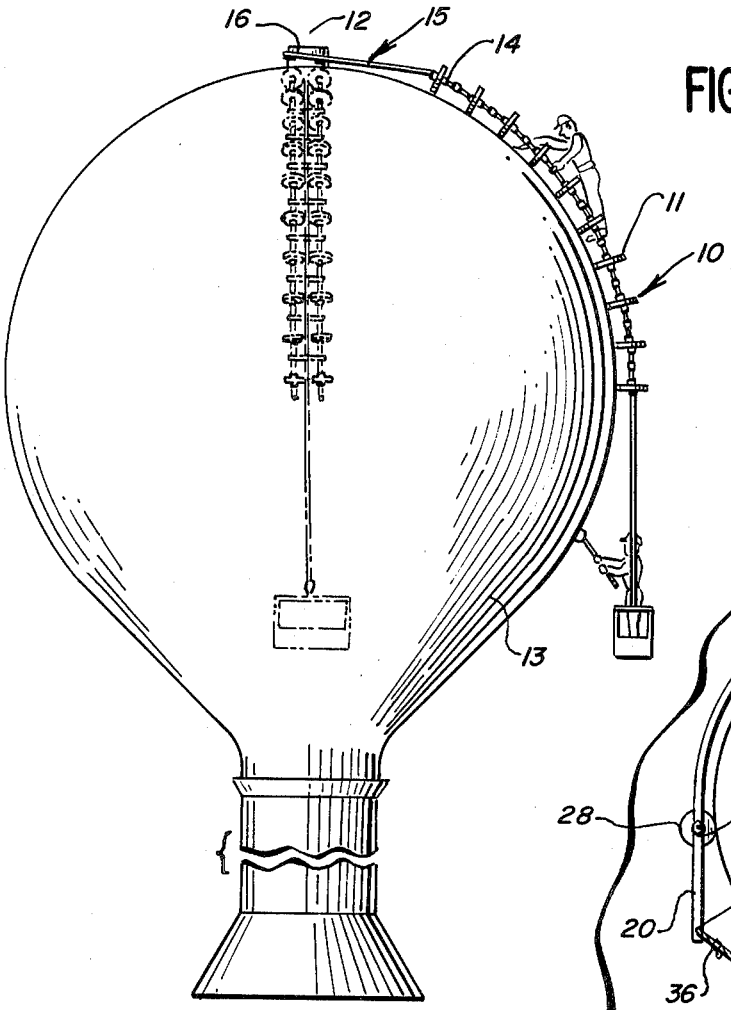
FIG. 1
FIG. 2
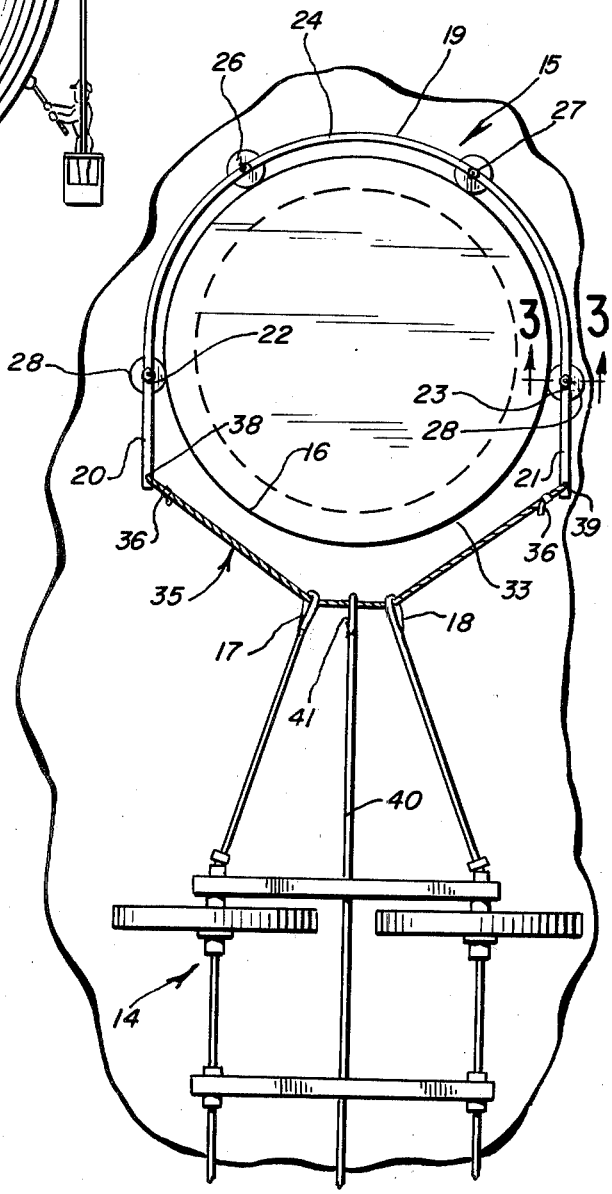
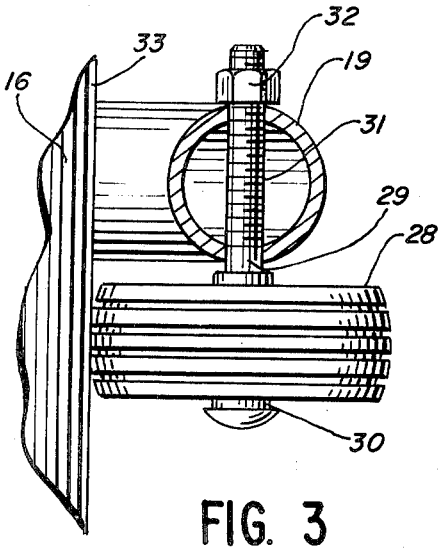
FIG. 3

ANCHORING DEVICE FOR FLEXIBLE LADDER

BACKGROUND OF THE INVENTION

1. Field of the Invention

This invention relates to flexible ladders and in particular to anchoring devices for use with such ladders.

2. Description of the Background Art

In U.S. Pat. No. 3,633,708 of the present applicant, a ladder is disclosed for use in painting spherical structures, such as storage spheroids. The ladder is provided with wheel means for facilitated movement about the spheroid during the painting operation, and includes an upper end connected to a post for anchoring the upper end of the ladder to the top of the spheroid.

SUMMARY OF THE INVENTION

The present invention is concerned with an improved anchoring device for connecting the upper end of such a flexible ladder to an upstanding annular access manhole projection on the top of the storage spheroid, or other spherical structure.

In the illustrated embodiment, the anchoring device includes an arcuate caster support, a plurality of casters rotatably mounted on the caster support, and a flexible connector extending between the opposite ends of the caster support and being arranged to have the upper end of the ladder connected thereto.

The anchoring device permits facilitated movement of the flexible ladder around the spheroid for improved facilitated painting operation or the like.

In the illustrated embodiment, the caster support is defined, in one form, by a rigid tubular element and in another form, by a fiberglass rod.

In the illustrated embodiment, the flexible connector comprises a wire rope.

The wire rope may have eye splices at its opposite ends for connection to the distal ends of the caster support.

In the illustrated embodiment, the casters include a pair of casters mounted to the support at the opposite ends thereof.

The distal ends of the caster support, in the illustrated embodiment, extend rectilinearly parallel to each other away from the access manhole projection for positioning a ladder upper end in spaced relationship to the access manhole projection for free rolling movement of the anchoring device about the projection, when desired.

In the illustrated embodiment, the casters include a pair of casters mounted at diametrically opposite portions of the caster support.

Thus, the anchoring device of the present invention is extremely simple and economical of construction while yet providing an improved means for connecting a flexible industrial ladder for facilitated positioning thereof on a spherical structure, such as a storage spheroid.

BRIEF DESCRIPTION OF THE DRAWING

Other features and advantages of the invention will be apparent from the following description taken in connection with the accompanying drawing wherein:

FIG. 1 is a fragmentary side elevation of a storage spheroid having a flexible ladder connected to the upstanding access manhole portion at the top thereof, such as for use in painting the spheroid;

FIG. 2 is a fragmentary plan view of the anchoring device and upper end of the flexible ladder; and FIG. 3 is a fragmentary enlarged vertical section taken substantially along the line 3—3 of FIG. 2.

DESCRIPTION OF THE PREFERRED EMBODIMENT

In the exemplary embodiment of the invention as disclosed in the drawing, a flexible ladder generally designated 10 is provided with a plurality of wheels 11 for permitting the ladder to be readily selectively positioned about the axis 12 of a spherical structure 13 illustratively comprising a storage spheroid. The upper end 14 of the ladder is connected by an improved anchoring device 15 to an upstanding annular access manhole projection 16 at the top of the spheroid.

Thus, as illustrated in FIG. 1, the flexible ladder may be readily moved about the surface of the spheroid, such as for facilitated painting of the spheroid.

The upper end of the flexible ladder, as shown in FIG. 2, may include a pair of eye splices 17 and 18 for connection thereof to the anchoring device 15.

More specifically, the anchoring device includes an arcuate caster support 19 having distal ends 20 and 21 extending in parallel relationship from diametrically opposite portions 22 and 23 at opposite ends of an arcuate portion 24, which, as shown in FIG. 2, extends at least approximately 180°.

A plurality of casters, illustratively comprising casters 25, 26, 27 and 28, are rotatably mounted to the caster support at circumferentially spaced positions, which, in the illustrated embodiment, are approximately 60° apart. The two end casters 25 and 28 are thusly mounted to diametrically opposite end portions 22 and 23 of the arcuate portion 24 of the support.

As shown in FIG. 3, in the illustrated embodiment, the casters may be rotatably mounted on an axle 29 having a hub portion 30 carrying the caster and a mounting portion 31 extending through the caster support 19 and being locked thereto as by a nut 32 threaded to the mounting portion 31 projecting upwardly from the caster support.

As further illustrated in FIG. 3, the caster wheels 28 ride against the outer surface 33 of the manhole projection 16 to provide a readily movable anchor for the upper end 14 of the ladder.

As illustrated in FIG. 2, the anchoring device further includes a flexible connector 35 having opposite ends 36 and 37 secured to the distal ends 20 and 21 of the caster support. In the illustrated embodiment, the flexible connector 35 comprises a wire rope and the oppose ends 36 and 37 define eye splices looped through suitable openings 38 and 39 in the caster support distal ends 20 and 21, respectively. The projection of the distal ends 20 and 21 from the diametrically opposite portions 22 and 23 of the arcuate portion 24 of the caster support spaces the flexible element 35 from the manhole projection surface 33 for free rolling movement of the anchoring device 15 about the manhole projection.

As shown in FIG. 2, the flexible connector 35 extends through the ladder eye splices 17 and 18 to support the upper end of the ladder to the anchoring device.

As further shown in FIG. 2, a safety line 40 may be provided with an eye splice 41 between the splices 17 and 18 to connect the safety line to the anchoring device in centered relationship to the flexible ladder 14.

In the illustrated embodiment, the manhole comprises a standard manhole having a diameter of approximately 27", with the arcuate portion 24 of the anchoring device extending approximately 54" about approximately 180° of the manhole projection, with approximately ½" clearance between the arcuate support portion and the outer surface 33 of the manhole projection.

The distal ends 20 and 21 of the anchoring device may extend approximately 3" in parallel relationship from the arcuate portion ends 22 and 23.

In one form, the caster support is defined by a 1" o.d. steel tube, in another form the caster support is formed by a steel bar, and in another form, the caster support is formed by a fiberglass rod. As will be obvious to those skilled in the art, any suitable configuration may be employed within the scope of the invention.

In the illustrated embodiment, the casters comprise 2" diameter casters. The flexible connector 35, in the illustrated embodiment, comprises a ⅜" wire rope.

The anchoring device 15 provides facilitated mounting of the upper end of the ladder to the manhole projection, provides optimum mobility and high strength in an extremely simple and economical construction.

The foregoing disclosure of specific embodiments is illustrative of the broad inventive concepts comprehended by the invention.

I claim:

1. For use with a flexible ladder having an upper end provided with connecting elements, an improved anchoring device for connecting said upper end to an upstanding annular access manhole projection such as provided on a storage spheroid, said anchoring device comprising:

an arcuate caster support extending at least approximately 180° and having opposite spaced distal ends;

a plurality of casters rotatively mounted to said caster support at circumferentially spaced positions for radially inner rolling engagement with said access manhole projection; and a flexible connector having ends secured to said caster support distal ends and arranged to have said flexible ladder connecting element movably connected thereto whereby the flexible ladder may be hung from the access manhole projection for ready adjustability on the spheroid about the vertical axis of said access manhole projection.

2. The flexible ladder anchoring device of claim 1 wherein said caster support comprises a rigid tubular element.

3. The flexible ladder anchoring device of claim 1 wherein said caster support comprises a steel tube.

4. The flexible ladder anchoring device of claim 1 wherein said caster support comprises a fiberglass rod.

5. The flexible ladder anchoring device of claim 1 wherein said flexible connector comprises a wire rope.

6. The flexible ladder anchoring device of claim 1 wherein said flexible connector comprises a wire rope having eye splices at its opposite ends connected to said distal ends of the caster support.

7. The flexible ladder anchoring device of claim 1 wherein said plurality of casters includes a caster mounted to said caster support at each of said distal ends.

8. The flexible ladder anchoring device of claim 1 wherein said distal ends comprise rectilinear portions extending parallel to each other.

9. The flexible ladder anchoring device of claim 1 wherein said plurality of casters includes a caster mounted to said caster support at diametrically opposite portions thereof.

10. The flexible ladder anchoring device of claim 1 wherein said caster support distal ends are arranged to project away from the access manhole projection for positioning a ladder upper end connected thereto in spaced relationship to the access manhole projection for free rolling movement of the anchoring device about the access manhole projection when desired.

* * * * *